United States Patent [19]

Fong

[11] Patent Number: 4,894,247

[45] Date of Patent: Jan. 16, 1990

[54] FIBROUS MICROWAVE SUSCEPTOR PACKAGE

[75] Inventor: Dan S. C. Fong, Wilmington, Del.

[73] Assignee: E. I. Du Pont de Nemours and Company, Wilmington, Del.

[21] Appl. No.: 131,663

[22] Filed: Dec. 11, 1987

[51] Int. Cl.[4] ..... A23L 3/10; H05B 6/64

[52] U.S. Cl. ..... 426/107; 206/805; 219/10.55 E; 219/10.55 M; 426/113; 426/234; 426/243

[58] Field of Search ..... 426/107, 113, 234, 243, 426/412; 219/10.55 E, 10.55 M, 10.55 R; 206/805; 53/440; 24/16 PB, 17 AP

[56] References Cited

U.S. PATENT DOCUMENTS

| | | | |
|---|---|---|---|
| 1,903,104 | 3/1933 | Fortuna et al. | 206/805 |
| 3,672,907 | 6/1972 | Hudson | 426/412 |
| 3,891,775 | 6/1975 | Murray et al. | 426/107 |
| 4,190,757 | 2/1980 | Turpin et al. | 219/10.55 |
| 4,204,105 | 5/1980 | Leveckis et al. | 219/10.55 |
| 4,230,924 | 10/1980 | Brasted et al. | 219/10.55 |
| 4,267,420 | 5/1981 | Brastad | 219/10.55 |
| 4,434,197 | 2/1984 | Petriello et al. | 427/407.1 |
| 4,518,651 | 5/1985 | Wolfe | 428/308.8 |
| 4,548,826 | 10/1985 | Watkins | 426/394 |
| 4,555,605 | 11/1985 | Brown et al. | 99/DIG. 14 |

*Primary Examiner*—George Yeung

[57] ABSTRACT

A package for uniform microwave cooking of a food item such as an egg roll, which requires surface browning or crispening, comprises a drapable, liquid permeable, microwave susceptive composite material draped around the food item, and a paper board holder having at least one cutout portion into which the wrapped food item nestles.

20 Claims, 3 Drawing Sheets

FIBROUS MICROWAVE SUSCEPTOR PACKAGE

BACKGROUND OF THE INVENTION

This invention relates to a package suitable for use in cooking egg rolls and similar food items in a microwave oven, and a process for packaging egg rolls and similar foods.

Microwave ovens have become widespread in recent years, and have provided a way to rapidly and conveniently cook many types of foods. Certain foods, however, have proven difficult to heat satisfactorily in a microwave oven. Since microwaves penetrate to the interior of the food and heat from the inside, they tend to drive moisture to the relatively cooler surface of the food, where it may condense. While this phenomenon is not particularly troublesome for many foods, for certain foods it presents serious problems. This is a particular problem for foods such as egg rolls, which, when traditionally prepared, have a hot moist interior of meat, noodles, vegetables, etc., and a hot, crispy exterior. However, when such food items are cooked in a microwave oven, the result is normally a soggy, unappetizing mass, with no surface crispness at all. To alleviate this problem and aid the browning and crispening of the surface of a cooked food item, there have been developed a number of packaging materials specially adapted for use in microwave cooking. Many such known packaging materials incorporate a microwave susceptor material, i.e., a material capable of absorbing the electric or magnetic portion of the microwave field energy to convert that energy to heat.

U.S. Pat. No. 4,276,420, to Brastad, discloses a packaging material which is a plastic film or other dielectric substrate having a thin semiconducting metallic coating. A food item is wrapped in the coated film so that the film conforms to a substantial surface portion of the food item. On exposure to microwave energy, the film converts some of that energy into heat which is transmitted directly to the surface portion by conduction so that a browning and/or crispening is achieved.

Copending U.S. Ser. No. 037,987, filed Apr. 13, 1987, Fisher and Huang, discloses composite materials comprising drapable, liquid permeable, woven or nonwoven, fibrous dielectric substrates. These substrates, or fibers of these substrates, are coated and/or imbibed with one or more susceptor materials. The composite materials of this application, by virtue of their being drapable, are capable of conforming substantially to the shape of the food item to be browned or crispened. The susceptor material converts a portion of the incident microwave radiation to heat, which imparts rapid browning and/or crispening to the exterior surface of the wrapped food item. The composite material also allows moisture evolved during heating of the food item to readily escape as vapor, thereby aiding and hastening browning and crispening of the food surface.

This invention provides a microwave active packaging system for food items such as egg rolls which permits the food item to be heated or cooked in a microwave oven, while simultaneously providing a browned, crisp surface. The package is convenient to use and maintains good contact between the microwave active packaging material and the food item during the course of the heating. The invention further permits uniform heating of all the areas of a packaged food item, even in microwave ovens with imperfect uniformity of the microwave field.

BRIEF DESCRIPTION OF THE INVENTION

The present invention provides a package useful for heating or cooking a food item in a microwave oven, comprising (a) a drapable, liquid permeable, microwave susceptive composite material, folded over said food item and in contact with the exterior surfaces of said food item, said composite material forming extensions beyond the periphery of said food item, the inner surfaces of said extensions being in contacting relationship with each other, said extensions forming a flap around at least a part of the periphery of said food item, and (b) a holder comprising two substantially flat parts, each part being provided with a cutout portion of a size and shape suitable for encompassing said food item contained within said composite material, wherein said parts of said holder are joined together face to face, the cutout portions being opposite each other and encompassing said food item and composite material, and wherein the flap formed from the composite material extends beyond the cutout portion and is sandwiched between the two flat parts of the holder, thereby securing said food item in said cutout portion.

The present invention further provides a package useful for heating or cooking a food item in a microwave oven containing a support means, said package comprising:

(a) a microwave compatible container containing said food item, and (b) an elastic string attached to said microwave compatible container, said elastic string being of such a length that said package can be suspended and hang freely from said support means within said microwave oven.

The present invention further provides a process for packaging a food item, comprising:

(a) placing the food item adjacent to a drapable, liquid permeable, microwave susceptive composite material, (b) folding said composite material so as to cover said food item and to form extensions beyond the periphery of said food item, the inner surfaces of said extensions being in contacting relationship with each other, (c) removing cutout portions from a piece of paper board, which cutout portions are of a size and shape suitable for encompassing said food item contained within said composite material, (d) folding the piece of paper board so that the cutout portions meet on either side of the fold, (e) placing the folded composite material containing the food item within the folded paper board so that the cutout portions encompass the food item, and (f) securing the piece of paper board in its folded configuration.

The invention also provides a process for cooking a food item in a microwave oven, comprising inserting such a package into the microwave oven and cooking the food contained therein for a time sufficient to attain the desired degree of cooking.

DETAILED DESCRIPTION OF THE INVENTION

This invention provides a packaging means which is also a means for heating or cooking foods which require a crispened or browned surface. Such foods include egg rolls, chicken parts, fish fillets, etc.

The food item is placed on and wrapped within a microwave active, drapable, liquid permeable, woven or nonwoven, fibrous, dielectric substrate, which substrate, or fibers of which substrate, are coated and/or imbibed with one or more microwave susceptor materials, the amount of said susceptor material being sufficient to generate adequate heat to rapidly brown or crispen the surface of the food item adjacent thereto without substantially impeding the ability of the microwave energy to penetrate the susceptor material and cook the food item. Such substrates are disclosed more completely in U.S. Ser. No. 037,987, filed Apr. 13, 1987, the disclosure of which is hereby incorporated by reference.

In brief, the composite materials which are used are fabric-like, and are permeable to liquids and vapors, such that moisture evolved during cooking can readily penetrate the fabric or evaporate, thus preventing the surface of the food item from becoming soggy. The microwave susceptor materials that are coated onto and/or imbibed into the substrate are materials which are capable of absorbing the electric and/or magnetic field components of the microwave energy and converting that energy into heat. Many such materials are known in the art and include metals such as nickel, antimony, copper, molybdenum, bronze, iron, chromium, tin, zinc, silver, gold, aluminum, and alloys, etc. Certain naturally occurring microwave susceptive food ingredients or flavors such as poly-and mono-saccharides and ionically conductive flavoring agents may also be used, as may be combinations of the above susceptors.

In a preferred embodiment, the susceptor material is one which responds to both the electric and the magnetic filed components of the incident microwave radiation, as disclosed in copending application U.S. Ser. No. 037,998, filed Apr. 13, 1987, the disclosure of which is hereby incorporated by reference. In another preferred embodiment, the susceptor material is in flake form and is preferably aluminum, as disclosed in copending application U.S. Ser. No. 002,980, filed Jan. 23, 1987, the disclosure of which is hereby incorporated by reference.

In order to understand how the packaging system of this invention operates, it is instructive to consider FIGS. 1–8.

Figure 1:
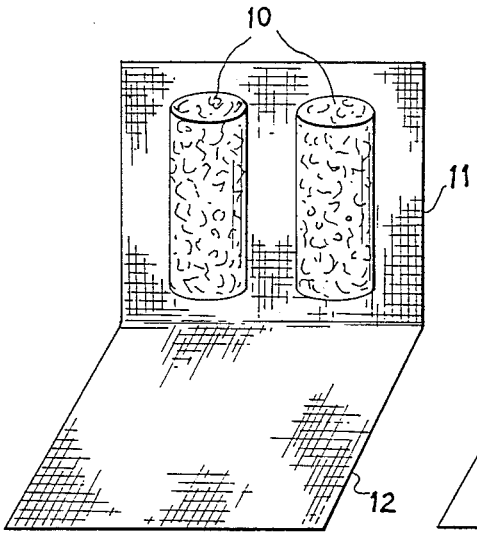
FIG. 1 shows two egg rolls placed on a sheet of microwave susceptor composite material.

The present invention may be used to package and cook one or more food items. FIG. 1 shows two food items (egg rolls), 10, to be packaged and heated. Both egg rolls are placed on a sheet of composite material, 11, described above. They are placed on the composite material in such a way that a part of the composite material, 13, can be folded or draped over the food items, thus covering them and making substantial contact with the exterior surfaces. It is important that a portion of the composite material extend beyond the periphery of each food item. This is so that the inner surfaces of the composite material from each side of the food item can meet together, face to face, to form a flap which at least partially encircles the periphery of each food item. This flap is important in helping to hold the food item in the paper board holder, described below. If the two surfaces of the composite material are not identical, the food item should be placed on the side which will provide more efficient heat transfer to the surface of the food item. For example, only one side of the composite material may be metallized. In that case the food item should normally be placed on the metallized side, to facilitate heat transfer.

Figure 2:
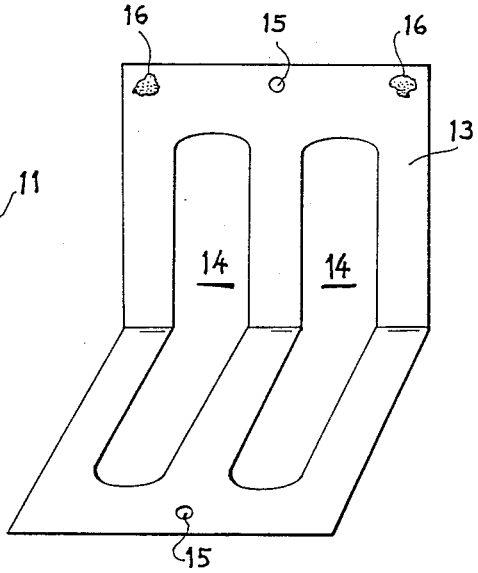
FIG. 2 shows a paper board holder, with two cutout sections.
Figure 4:
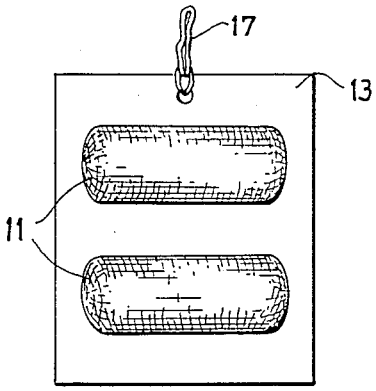
FIG. 4 shows an alternative embodiment of the packaging system.
Figure 5:
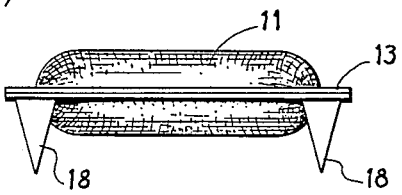
FIG. 5 shows yet another embodiment of the packaging system.

FIG. 2 shows a holder, 13, in this case prepared from paper board, with two cut out portions, or holes, 14, one for each of two egg rolls to be contained in this particular package. The paper board holder is creased to form two substantially flat parts. The food items, covered with the composite material, can be nestled in the holes, and the two parts can be folded together over the food items and the composite material, and secured. The cutout portions are of the correct size and shape to at least partially encompass the food item. That is, when the paper board holder is folded, each resulting hole is of the approximate shape of the periphery of the food item and of a size sufficiently large to fit around the periphery of the food item contained within the composite material, yet sufficiently small that, when the food item is nestled in the cutout portion, the flap formed from the composite material extends beyond the cutout portion. The flap is thus sandwiched between the flat surfaces of the holder, and serves to secure the food item in place. A single elongated hole, 14, as shown, can be used to enclose each food item, or each half of the holder can have a distinct cut-out portion completely encompass the food item. (Such an arrangement is illustrated in FIG. 4.) Two additional small holes 15 are also shown, which are optionally used to hold the elastic band or string, such as a rubber band or other length of elastic string, cord, or yarn, described below.

FIG. 2 also shows adhesive, 16, applied to the paper board holder, which may optionally be used to secure the holder in its folded position after the food items and composite material are in place. In many cases the overall dimensions of the holder will be greater than those of the composite material draped about the food items, so that the adhesive can directly bind the two parts of the holder together. The holder may be secured by any appropriate means, including plastic staples, overlapping paper tabs, stitching, etc., although normally the use of an adhesive will be preferred.

The holder need not be prepared from a single piece of paper board with a crease, but may also be prepared by securing together two or more separate pieces of paper board or other suitable material, having the appropriate cutout portions. However, for simplicity of manufacture and use, a paper board holder prepared from a single piece of paper board is preferred.

Figure 3:
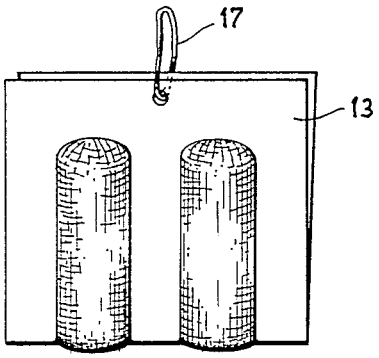
FIG. 3 shows the two egg rolls and the composite material of FIG. 1, folded within the paper board holder.

FIG. 3 shows a completed package including paper board holder, 13, composite material, 11, and, obscured by the composite material, the food items. This figure also shows an elastic string, 17, attached to the paper board holder by means of hole 15. The function of the elastic string will be described in more detail hereinafter.

Figure 6:
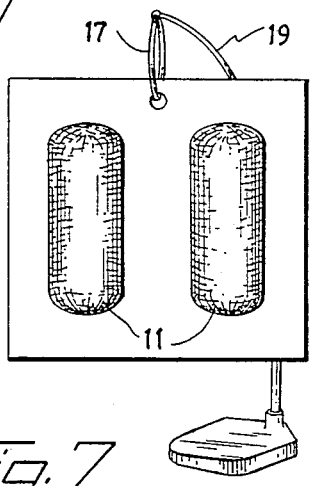
FIG. 6 shows an embodiment of the invention, mounted as it might be within a microwave oven.

FIG. 6 shows an embodiment of the invention as it might be used for cooking within a microwave oven. In this figure the package is suspended by the elastic string from a support system 19 which rests on the floor of the microwave oven. In addition to the arcuate support system shown in FIG. 6, a similarly oriented support system in the shape of a circle or hoop has proved satisfactory. The package may be supported by hanging it from a hook or other support means, provided as a part of the support system, or even attached to the ceiling of the oven cavity, without a separate support system. The support means should be at a sufficient height that the package can be suspended and hang freely by its elastic string. Likewise, the elastic string should be of such a length that the package can be suspended and hang freely from the support means. Many equivalent configurations of support systems are possible within the scope of this invention.

Microwave ovens are well known for their nonuniform cooking, due to the presence of hot and cold spots. The elastic string serves to ameliorate these nonuniformities. If the elastic string is simply wound up or twisted before the package is suspended within the oven, the energy stored within the string will cause the package to rotate or oscillate within the oven for ten to twenty minutes, thus helping to provide uniform heating of the food item during the cooking cycle. Thus the food item can be uniformly cooked or heated until the desired amount of cooking is achieved.

Figure 8:
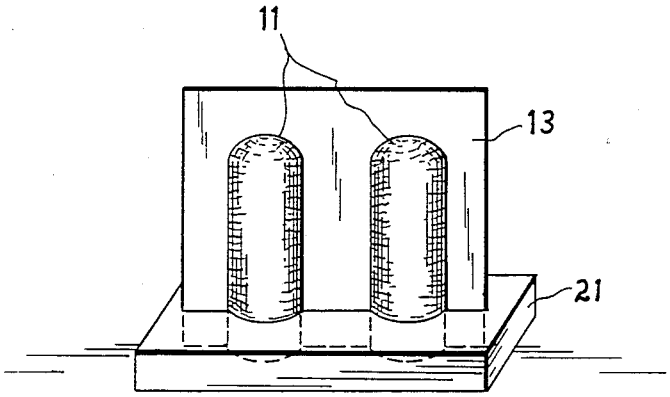
FIG. 8 shows another embodiment of the packaging system, inserted in a paper board stand.

Although the use of such an elastic string is preferred, it may not be necessary for ovens which are equipped with a turntable or other means for assuring uniformity of heating. For such ovens the package shown in FIG. 5 may be appropriate. This figure shows a side view of a package similar to that of FIG. 3 or 4, in which an elastic string is not present, and the package is not suspended in the oven. Rather, foldout leg portions 18 are provided for support as a part of the paper board holder. The package is placed on the turntable, which is preferably rotated during the cooking process. Alternatively it may be desired to have the food item cook in a vertical position, standing on a turntable. Such an arrangement is shown in FIG. 8, in which the package is supported in a base 21 adapted to hold the paper board holder in a vertical position. The base may conveniently be a paper board box containing cutout portions, which can also be used as an outer package for shipment and sale of the food items.

Figure 7:
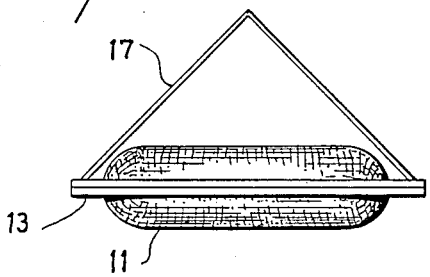
FIG. 7 shows an alternative embodiment of the packaging system particularly adapted for use in smaller capacity ovens.

It is clear that there are numerous other modifications of the geometry of this system which are possible without departing from the spirit of the invention. For example, FIG. 4 shows a package of the present invention, in which the holes are along the horizontal section of the package. FIG. 7 shows an alternative embodiment particularly suited for cooking in a small microwave oven. In this figure one or more elastic strings are attached so that the package and its contents are suspended in a horizontal plane in the oven. The elastic string may be wound up, as described above, causing the package and the food contents to rotate about a vertical axis.

It should be noted that the present invention is not limited to suspending packages which are prepared using a microwave susceptive composite material and a paper board holder. Rather, the invention includes a package and process for cooking a food item contained in any microwave compatible container, where the package is provided with an elastic string which can be used to suspend the container within the microwave oven. Twisting the string and suspending the package in the oven permits the package to rotate or oscillate freely during the cooking time. Thus improved uniformity of cooking can be achieved whether or not the food item is wrapped in a microwave susceptive composite material.

The packaging system of the present invention is suited for manufacture by any of a number of methods. One simple, continuous way to prepare such packages is to begin with a roll of microwave susceptive composite material, as described above, and a roll of paper board, which may be preprinted with advertising or other information for the consumer. Each material may be unrolled, simultaneously. Periodically an object of food is placed adjacent to the composite material, which is folded in one direction (e.g., upward), over the food item, by means of an automatic folding device such that the susceptor surface is preferably facing inward toward the food item. Meanwhile, the appropriate holes are cut in the paper board, which likewise passes through a folding device so that it is folded in the opposite direction (e.g., downward). The paper board and the composite material, containing the food item, are automatically brought together in such a way that the two portions fit together and the food item is nestled in the cutout portions of the paper board holder. The paper board is secured in its folded configuration by an adhesive, staples, etc., and the individual packages are separated by cutting at the appropriate locations. The package may be further finished, if desired, by any of the customary means such as boxing or overwrapping by, for example, shrink wrapping. The latter may be particularly suitable if the food item contains a high oil content or if the composite material is permeated with oil.

I claim:

1. A package useful for heating or cooking a food item in a microwave oven, comprising (a) a drapable, liquid permeable, microwave susceptive composite material comprising a fibrous dielectric substrate treated with at least one microwave susceptor material, said composite material being folded over said food item and in contact with the exterior surfaces of said food item, said composite material forming extensions beyond the periphery of said food item, the inner surfaces of the extensions being in contacting relationship with each other, the extensions forming a flap around at least a part of the periphery of said food item, and (b) a holder comprising two substantially flat parts, each part being provided with a cutout portion of a size and shape suitable for encompassing said food item contained within said composite material, wherein the parts of said holder are joined together face to face, the cutout portions being opposite each other and encompassing said food item and composite material, and wherein the flap formed from said composite material extends beyond said cutout portion and is sandwiched between the two flat parts of said holder, thereby securing said food item in the cutout portion.

2. The package of claim 1 wherein the drapable, liquid permeable, microwave susceptive composite material comprises a fibrous, dielectric substrate, which substrate is treated with at least one microwave susceptor material, the amount of said microwave susceptor material being sufficient to generate adequate heat to rapidly brown or crispen the surface of said food item without substantially impeding the ability of the microwave energy to penetrate said susceptor material and cook said the food item.

3. The package of claim 1 wherein the holder extends beyond the flap formed from the composite material.

4. The package of claim 3 wherein the holder is made of paper board.

5. The package of claim 1 further comprising a means for supporting said package within the interior of a microwave oven.

6. The package of claim 5 wherein the supporting means comprises foldout leg portions formed as a part of the holder.

7. The package of claim 5 wherein the supporting means is an elastic string attached to the holder, said elastic string being of such a length that said package can be suspended and hang freely within said microwave oven.

8. The package of claim 5 wherein the supporting means is a paper board base adapted to hold the holder in a vertical position.

9. The package of claim 7 wherein the elastic string is attached to said holder by means of a hole in said holder through which said elastic string is passed.

10. The package of claim 1 wherein the holder comprises a single piece of paper board, which is folded to form the two parts of said holder.

11. The package of claim 10 wherein the holder is secured in its folded configuration by means of an adhesive.

12. A package useful for heating or cooking a food item in a microwave oven containing a support means, said package comprising:

(a) a microwave compatible liquid permeable container containing said food item, and (b) an elastic string attached to said microwave compatible container, said elastic string being of such a length that said package can be suspended and hang freely from said support means within the microwave oven.

13. A process for cooking a food item in a microwave oven, comprising inserting the package of claim 1 into said microwave oven and cooking said food contained therein for a time sufficient to attain the desired degree of cooking.

14. A process for cooking a food item contained in the package of claim 7 in a microwave oven, the cavity of said oven containing a support means at a sufficient height that said package can be freely suspended therefrom by means of said elastic string, said process comprising:

(a) imparting twist to said elastic string, (b) inserting said package into the microwave oven, (c) suspending said package from said support means by means of said elastic string, whereby said package oscillates freely within the oven cavity, and (d) cooking the food contained therein for a time sufficient to attain the desired degree of cooking.

15. A process for cooking a food item contained in the package of claim 12 in a microwave oven, the cavity of said oven containing a support means at a sufficient height that said package can be freely suspended therefrom by means of said elastic string, comprising:

(a) imparting twist to said elastic string, (b) inserting said package into the microwave oven, (c) suspending said package from said support means by means of said elastic string, whereby the package oscillates freely within the oven cavity to an extent sufficient to permit uniform cooking by microwave energy, and (d) cooking the food contained therein for a time sufficient to attain the desired degree of cooking.

16. A process for packaging a food item, comprising:

(a) placing said food item adjacent to a drapable, liquid permeable, microwave susceptive composite material comprising a fibrous dielectric substrate treated with at least one microwave susceptor material, (b) folding said composite material so as to cover said food item and to form extensions beyond the periphery of said food item, the inner surfaces of said extensions being in contacting relationship with each other, (c) removing cutout portions from a piece of paper board, which cutout portions are of a size and shape suitable for encompassing said food item contained within said composite material, (d) folding said piece of paper board so that the cutout portions meet on either side of the fold, (e) placing said folded composite material containing said food item within the folded paper board so that the cutout portions encompass the food item, and (f) securing said piece of paper board in its folded configuration.

17. The process of claim 16 wherein the composite material is supplied from a continuous roll and the paper board is supplied from a continuous roll, and the packaged food item is separated from the continuous roll of composite material and the continuous roll of paper board by cutting, after the paper board is secured in its folded configuration.

18. The process of claim 17 wherein the composite material is folded in one direction and the paper board is folded in the opposite direction.

19. The package of claim 12 wherein the microwave compatible container is made of paperboard and has at least one cutout portion of a size and shape suitable for encompassing said food item contained therein.

20. A package useful for heating or cooking a food item in a microwave oven containing a support means, said package comprising:

(a) a microwave compatible container containing said food item, (b) an elastic string attached to said microwave compatible container, said elastic string being of such a length that said package can be suspended and hang freely from said support means within the microwave oven, and (c) a drapable, liquid permeable, microwave susceptive composite material comprising a fibrous dielectric substrate treated with at least one microwave susceptor material, wrapped about said food item.

* * * * *